US006378944B1

(12) United States Patent
Weisser

(10) Patent No.: US 6,378,944 B1
(45) Date of Patent: Apr. 30, 2002

(54) SEAT AND/OR BACK OF SEAT COVER FOR A CHAIR

(75) Inventor: Frank Weisser, Pegnitz (DE)

(73) Assignee: Koenig + Neurath AG, Karben (DE)

( * ) Notice: Subject to any disclaimer, the term of this patent is extended or adjusted under 35 U.S.C. 154(b) by 0 days.

(21) Appl. No.: 09/631,922

(22) Filed: Aug. 3, 2000

(30) Foreign Application Priority Data

Mar. 29, 2000 (DE) ..... 200 05 818 U

(51) Int. Cl.[7] ..... A47C 7/00

(52) U.S. Cl. ..... 297/440.11; 297/452.18; 297/218.5; 160/369; 160/380; 52/222

(58) Field of Search ..... 297/440.11, 452.38, 297/218.5, 452.18; 52/222; 160/369, 371, 380, 391, 395

(56) References Cited

U.S. PATENT DOCUMENTS

| | | | | |
|---|---|---|---|---|
| 4,189,880 A | * | 2/1980 | Ballin | 52/202 |
| 5,015,034 A | * | 5/1991 | Kindig et al. | 297/227 |
| 5,301,737 A | * | 4/1994 | Martin | 160/380 |
| 6,254,190 B1 | * | 7/2001 | Gregory | 297/452.1 |

* cited by examiner

*Primary Examiner*—Robert Canfield
(74) *Attorney, Agent, or Firm*—Herbert L. Lerner; Laurence A. Greenberg; Werner H. Stemer

(57) ABSTRACT

The invention relates to a seat and/or backrest covering for a chair, in particular an office chair, having a frame-tensioned mesh-like fabric (3), which is penetrated by a large number of pins (4) provided on the periphery of a load-bearing frame (1) that surrounds the seat or backrest, and is held by means of a covering frame (2) fitted onto the load-bearing frame (1).

15 Claims, 4 Drawing Sheets

SEAT AND/OR BACK OF SEAT COVER FOR A CHAIR

BACKGROUND OF THE INVENTION

FIELD OF THE INVENTION

The invention relates to a seat and/or backrest covering for a chair, in particular an office chair, having a frame-tensioned mesh-like fabric.

In an office chair disclosed by EP 0 856 269 A2 and having a synchronizing mechanism for adjusting the inclination of its seat/backrest unit, the seat and the backrest are covered by a mesh-like fabric. For this purpose, the mesh-like fabric is clamped in a flexible frame which, for its part, is inserted with a form fit into a peripheral groove of a load-bearing frame forming the load-bearing structure of the seat or the backrest. This type of mesh covering of the seat and/or of the backrest of a chair is very complicated in production terms.

SUMMARY OF THE INVENTION

The invention is therefore based on the object of specifying a comparatively simple type of mesh covering of the seat and/or the backrest of a chair, in particular an office chair.

According to the invention, this object is achieved by the features of claim 1. For this purpose, the mesh-like fabric is held by means of a large number of bolt-like or needle-like pins, which are arranged on the periphery of a load-bearing frame forming the load-bearing structure of the seat or the backrest. The tensioning of the mesh or of the fabric is in this case carried out either when the mesh-like fabric is fitted directly onto the pins, for example by each or every second mesh or the mesh of fabric being led over such a pin. A covering frame fitted onto the load-bearing frame on the mesh side ensures that the mesh-like fabric is held on the load-bearing frame.

Alternatively, however, the tensioning of the mesh is carried out by means of the covering frame, by the fabric which is fitted onto the load-bearing frame and whose mesh is penetrated by the pins in the manner of a penetration technique being tensioned by means of contours and mating contours provided on the covering frame, on the one hand, and on the load-bearing frame, on the other hand, when the covering frame is joined to the load-bearing frame.

The covering frame is expediently positioned and/or held on the load-bearing frame by means of a tongue-and-groove joint which runs on the frame faces, facing the mesh-like fabric, of the covering frame and of the load-bearing frame, underneath the pins, which are preferably arranged in a comb-like manner. The groove is expediently provided on the load-bearing frame and the tongue on the covering frame. As a result, by means of the tongue contour provided on the covering frame, the mesh-like fabric held by the pins arranged peripherally on the frame is drawn into the groove provided on the load-bearing frame and tensioned in the process. If this tongue-and-groove joint is used only for positioning, then the covering frame is expediently held on the load-bearing frame by means of screws or the like.

At the same time as the covering frame and the load-bearing frame are joined, the pins arranged on the latter in a single-row or multi-row configuration penetrate into a corresponding groove which is provided in the covering frame and which advantageously clamps around the pins with a form fit. As a result, uniform mesh tensioning with simultaneously secure holding of the covering frame on the load-bearing frame is ensured in a simple way. Alternatively, instead of this groove, a row of holes accommodating the pins and having a number of holes which correspond with said pins and whose number corresponds to the number of pins. In this case, all or individual pins can be provided with a head, expediently a spherical head, that latches into the hole, which is then of corresponding design, in the manner of a clip-in or snap-in connection. This provides an additional or alternative method of holding the covering frame on the load-bearing frame.

Exemplary embodiments of the invention will be explained in more detail below using a drawing, in which:

DESCRIPTION OF THE PREFERRED EMBODIMENT

Mutually corresponding parts are provided with the same reference symbols in all the figures.

Figure 1A:
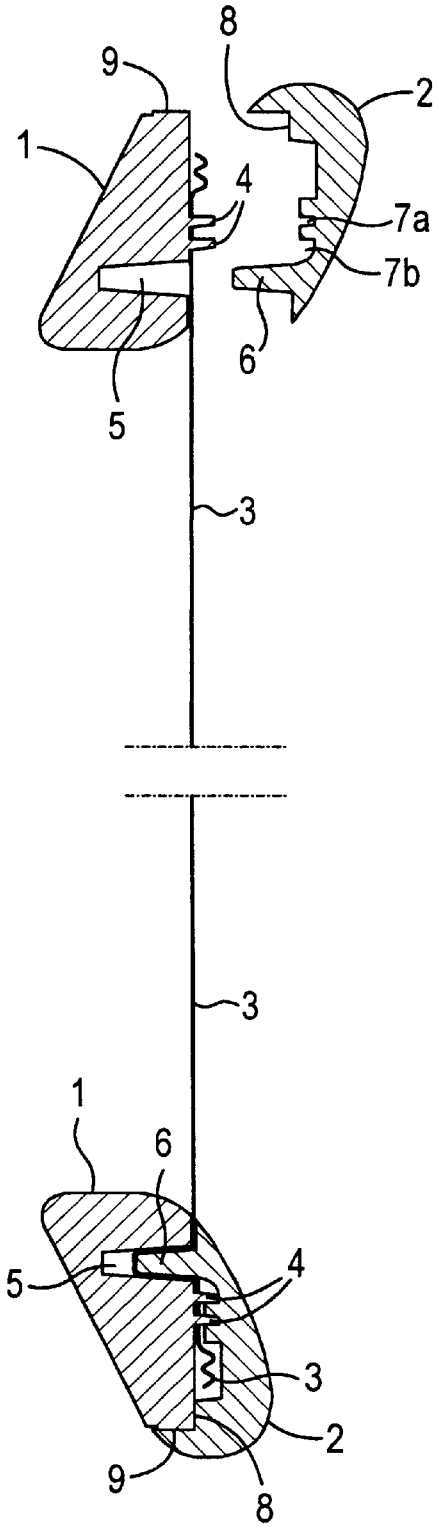
FIGS. 1*a* and 1*b* show schematically, in a sectional illustration, a mesh-like fabric fixed on a load-bearing frame in the state in which it is not tensioned and tensioned by means of a covering frame.
Figure 1B:
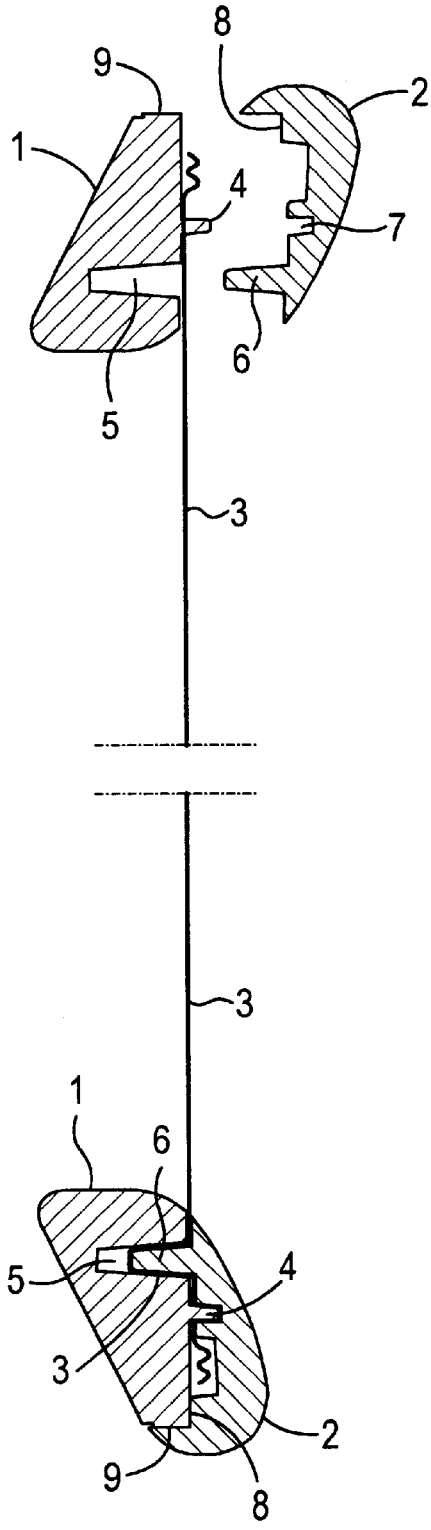

FIGS. 1*a* and 1*b* show cross sections of a load-bearing frame 1 and of a covering frame 2 with a mesh-like fabric 3 which is located between them and is tensioned by means of the two frames 1 and 2. In this case, the unjoined state of the two frames 1 and 2 is shown in the upper half of the figures, the mesh-like fabric 3 being penetrated by a large number of pins provided on the load-bearing frame 1. While two rows of pins 4 are provided in the embodiment according to FIG. 1*a*, the load-bearing frame 1 according to FIG. 1*b* has only one row of pins 4.

Figure 2A:
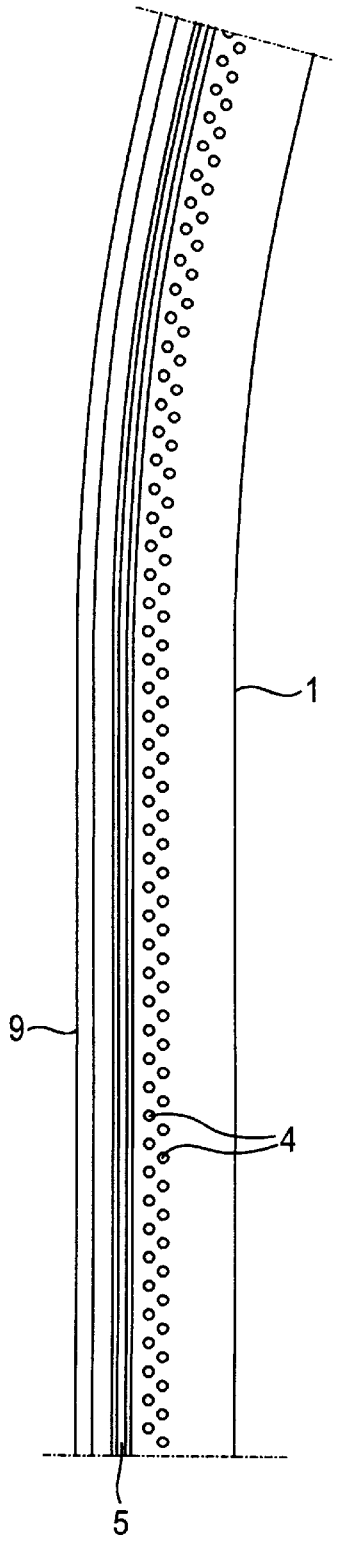
FIGS. 2*a* and 2*b* show, in a detail, the load-bearing frame contour according to FIG. 1 with a two-row of single-row pin arrangement.
Figure 2B:
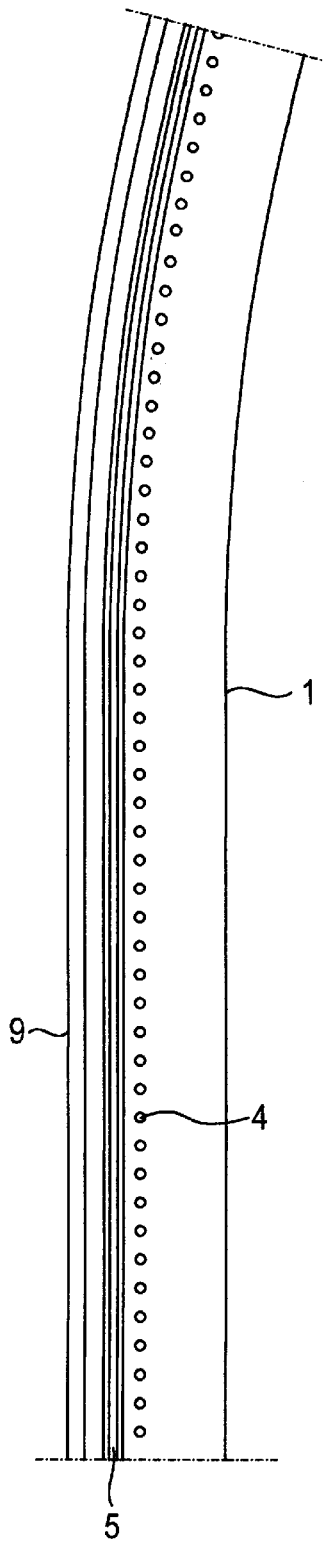

The arrangement of the pins 4 along the periphery of the load-bearing frame 1, which forms the load-bearing structure of the seat or of the backrest of a chair (not specifically illustrated), is shown in FIGS. 2*a* and 2*b* in relation to the two variants according to FIGS. 1*a* and 1*b*. FIG. 2*a* reveals that, in the case of the two-row structure of the pins 4, these are arranged uniformly and expediently equidistantly in a comb-like arrangement, offset in relation to one another, on the periphery of the load-bearing frame 1.

The load-bearing frame 1 has a peripheral groove 5, whose corresponding mating piece is integrally molded on the covering frame 2 in the form of a tongue 6. This tongue-and-groove joint 5, 6 is used to position the frames 1, 2 in relation to each other when they are joined. The covering frame 2 can then be held on the load-bearing frame 1 by additional means, such as a screw fixing, or by means of a latch-in or snap-in connection between the two frames 1, 2. In this case, the tongue-and-groove joint 5, 6 can already be designed as a latch-in connection. Alternatively, additional latching elements can be provided on the frames 1, 2.

In addition, in the embodiment according to FIG. 1*b*, the covering frame 2 has a single groove 7 and, in the embodiment according to FIG. 1*a*, has two grooves 7*a* and 7*b*, each of which corresponds with one of the rows of pins 4. In the state illustrated in the lower half of FIGS. 1*a* and 1*b*, in which the covering frame 2 is joined to the load-bearing frame 1, the pins 4 preferably engage with a form fit into the corresponding grooves 7*a*, 7*b* and 7, so that the respective groove 7*a*, 7*b* and 7 clamps around the corresponding row of pins 4. Instead of the groove 7 or 7*a*, 7*b*, a row of holes can also be provided in the covering frame 2 in a manner not specifically illustrated, the pins 4 engaging in these holes. Said pins can also, for example, be designed in the manner of spherical-headed pins and latch into the corresponding holes when the frames 1, 2 are joined.

When the covering frame 2 and the load-bearing frame 1 are joined, the tongue 6 draws the portion of the mesh-like fabric 3 which faces said tongue into the corresponding groove 5 in the load-bearing frame 1. As a result, the mesh-like fabric 3 is tensioned. A step-like inner contour 8 on the covering frame 2 engages around the outer, upper edge 9 of the load-bearing frame 1, so that when the two frames 1 and 2 are joined, overall an approximately oval outer or overall contour of the frame connection 1, 2 is formed.

Figure 3A:
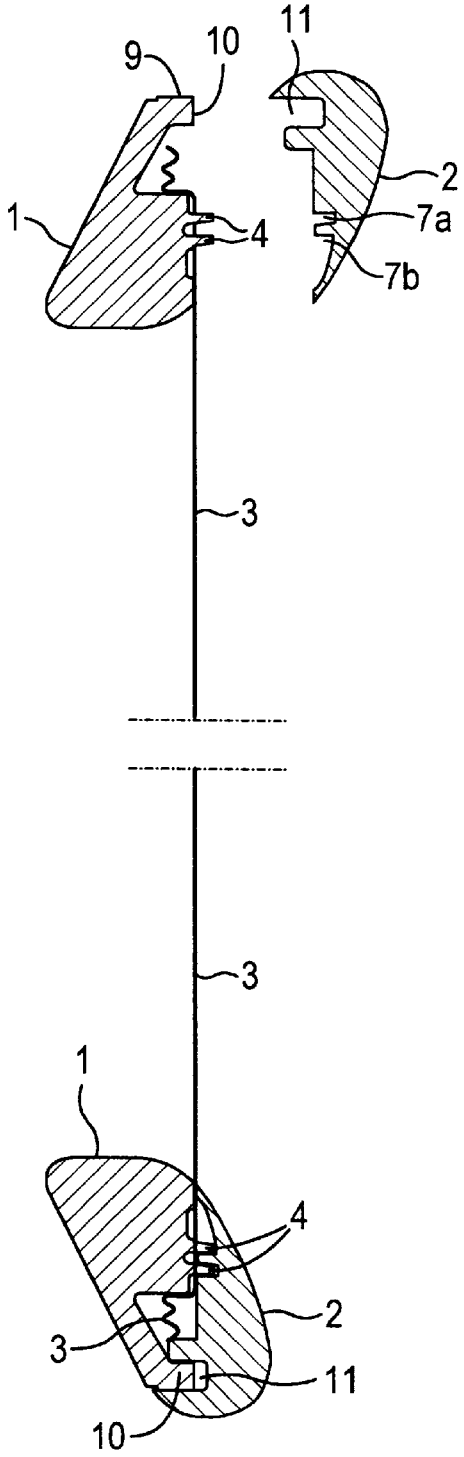
FIGS. 3*a* and 3*b* show an alternative embodiment with a fabric already tensioned on the load-bearing frame, in the unjoined and joined state of the frames.
Figure 3B:
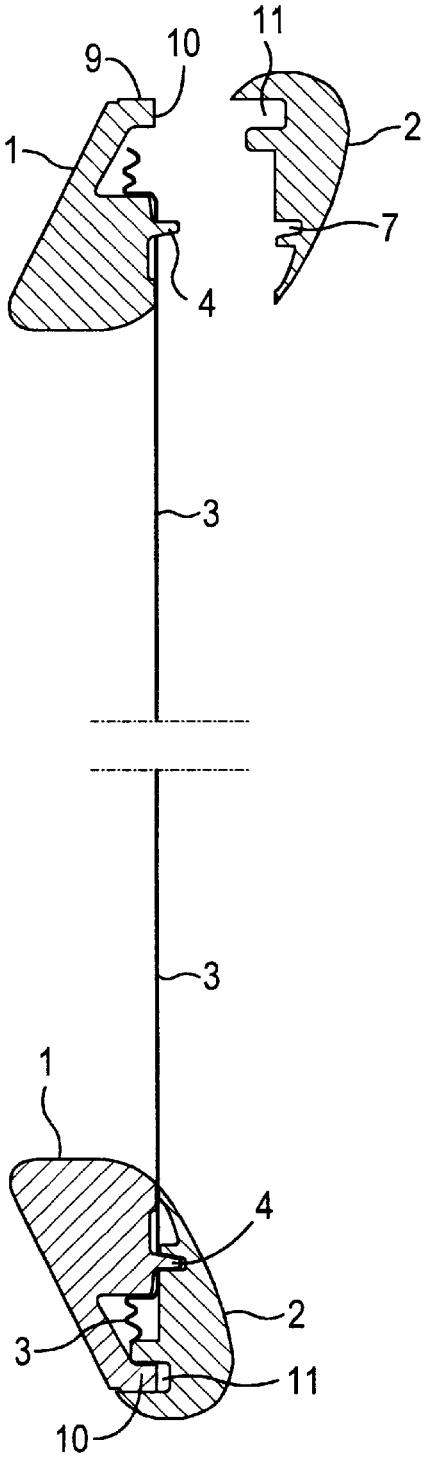
Figure 4A:
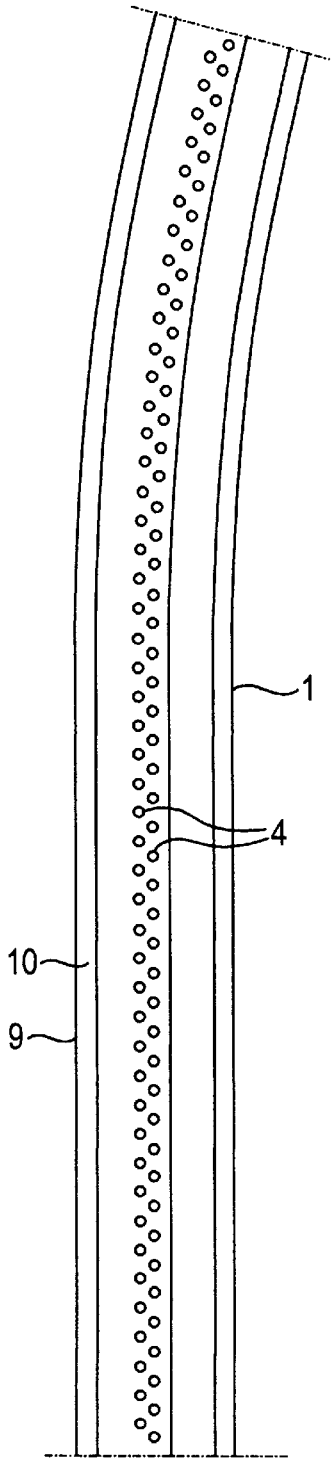
FIGS. 4*a* and 4*b* show, in an illustration according to FIGS. 2*a* and 2*b*, the load-bearing frame contour according to the variant of FIG. 3.
Figure 4B:
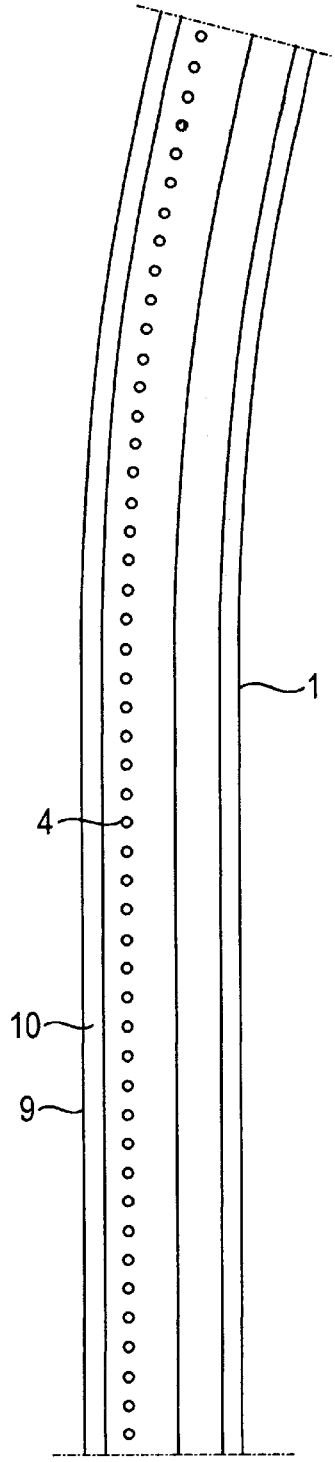

In the embodiment according to FIGS. 3*a* and 3*b*, the mesh-like fabric 3 is again penetrated by the pins 4 in a single-row or two-row design, and is already tensioned in the process. In the joined state illustrated in the lower half of FIGS. 3*a* and 3*b*, the pins 4 again engage in corresponding grooves 7*a* and 7*b* or 7 or in holes in corresponding rows of holes. By means of a tongue-like contour 10 provided on the outer, upper frame edge 9 of the load-bearing frame 1, on the one hand, and a corresponding groove-like contour 11 on the covering frame 2, on the other hand, again a reliable tongue-and-groove joint is ensured in the joined state. The corresponding frame profile of the load-bearing frame 1 of this variant according to FIGS. 3*a* and 3*b* is shown in FIGS. 4*a* and 4*b*.

Overall, the two frames 1 and 2 have corresponding inner profiles which are designed in order to provide a reliable joint in the manner of a tongue-and-groove contour.

I claim:

1. A covering for a chair, comprising:

a mesh fabric;

a load-bearing frame having a plurality of pins projecting from a periphery thereof and penetrating said mesh fabric; and a covering frame fitted onto said load-bearing frame for holding taut said mesh fabric to form a seat or backrest surface of a chair.

2. The covering according to claim 1, wherein said covering frame is provided for tensioning said mesh fabric.

3. The covering according to claim 1, wherein said covering frame and said load-bearing frame are provided with a mutually interengaging tongue-and-groove joint.

4. The covering according to claim 3, wherein said tongue-and-groove joint is formed underneath said pins on respective frame faces, facing said mesh fabric.

5. The covering according to claim 3, wherein said tongue-and-groove joint comprises a groove formed in said load-bearing frame and a tongue formed on said covering frame.

6. The covering according to claim 3, wherein said tongue-and-groove joint comprises a groove in said covering frame and a tongue formed on said load-bearing frame.

7. The covering according to claim 1, wherein said pins are arranged along a single peripheral comb-shaped row on said load-bearing frame.

8. The covering according to claim 1, wherein said pins are arranged along a plurality of peripheral comb-shaped rows on said load-bearing frame.

9. The covering according to claim 1, wherein said covering frame has an inner side, facing said pins, formed with a peripheral groove accommodating said pins.

10. The covering according to claim 9, wherein said groove is formed to clamp around said pins with a form fit.

11. The covering according to claim 1, wherein said covering frame has an inner side, facing said pins, formed with a row of holes accommodating said pins.

12. The covering according to claim 11, wherein said pins are formed with pinheads latching into respective holes in said row of holes.

13. The covering according to claim 12, wherein said pinheads are spherical pinheads.

14. In combination with a chair having a seat, the covering according to claim 1, wherein said load-bearing frame and said covering frame surround the seat of the chair.

15. In combination with a chair having a backrest, the covering according to claim 1, wherein said load-bearing frame and said covering frame surround the backrest of the chair.

* * * * *